US008256976B2

(12) United States Patent
Edwards et al.

(10) Patent No.: US 8,256,976 B2
(45) Date of Patent: Sep. 4, 2012

(54) EDGE GUIDE ADJUSTMENT SYSTEM

(75) Inventors: Mark Joseph Edwards, Lexington, KY (US); John Paul NeCamp, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 588 days.

(21) Appl. No.: 12/344,850

(22) Filed: Dec. 29, 2008

(65) Prior Publication Data

US 2010/0166484 A1 Jul. 1, 2010

(51) Int. Cl.
*B41J 13/00* (2006.01)

(52) U.S. Cl. ..... 400/642

(58) Field of Classification Search ..... 400/248.3, 400/354.3, 456, 460, 461, 491.3, 642; 340/815.4; 271/162

See application file for complete search history.

(56) References Cited

U.S. PATENT DOCUMENTS 6,304,731 B1 * 10/2001 Able et al. ..... 399/45
2006/0045601 A1 * 3/2006 Endo ..... 400/642
2006/0255531 A1 * 11/2006 Azzopardi et al. ..... 271/171

* cited by examiner

*Primary Examiner* — Seung Lee
(74) *Attorney, Agent, or Firm* — John Victor Pezdek

(57) ABSTRACT

The invention describes a method and system for correct positioning of a plurality of edge guides of a media source assembly. The system senses the proximity of documents with the plurality of edge guides by employing one or more sensors. Based on the sensed proximity, the one or more sensors provide notifications to the user through one or more indicators.

13 Claims, 8 Drawing Sheets

510

EDGE GUIDE ADJUSTMENT SYSTEM

BACKGROUND

1. Field of the Invention

The present invention relates generally to an image forming device, and more particularly, to a method and system for improving the adjustments of a plurality of edge guides in the image forming device.

2. Description of the Related Art

An image forming device produces an image or a copy as an output of a document or print media containing text, graphics, or a combination thereof. Examples of image forming devices include, but are not limited to, printers, scanners, and copiers. In printers, scanners, and copiers, processing of the document depends on the correct positioning of the document or the print media in a media source assembly. If the document or the print media is not placed correctly on the media source assembly, it may get skewed, and thus, cause jams in the image forming device. Typically, in the majority of media source assemblies, multiple edge guides are used to adjust the position of the document.

One common limitation associated with the adjustment of the document in the media source assembly is the difficulty in engaging a user in adjusting the plurality of edge guides properly. Manufacturers of image forming devices use different methodologies to overcome this limitation. Some manufacturers provide user manuals along with the image forming devices. These user manuals include edge guide adjustment diagrams that provide instructions to the user about how the edge guides should be adjusted against the document. However, this can be a tedious and time-consuming activity for the user. Further, users generally do not prefer reading the user manual. Furthermore, in some cases, in spite of reading the user manual, the users may not be able to follow the instructions appropriately.

In some image forming devices, a plurality of icons and notations may be provided on the media source assembly for instructing the user to adjust the edge guides. However, such icons and notations may be overlooked by the user. Further, in some cases, in spite of looking at the icons and notations, the user may not be able to adjust the edge guides properly.

There are also some image forming devices that are equipped with fixed edge guides for processing a set of documents having a similar size such as one of letter size, legal size, A4 size, and the like. However, such image forming devices cannot be used for processing the documents or print media having different sizes.

SUMMARY OF THE INVENTION

The embodiments of the present invention overcome the limitations of prior media source assemblies of an image forming device; thereby satisfying the need for a system and a method for correct positioning of a plurality of edge guides of the media source assemblies. Various embodiments of the present invention may prompt a user through multiple video/audio instructions to adjust the edge guides. Prompting the user may include, for example, guiding the user to adjust the plurality of edge guides through alternative methods or ways, such as one or more text messages, a graphical representation on a display, a video on a display, and through audio instructions. Further, the image forming device according to embodiments of the present invention requires minimal user intervention.

The embodiments of the present invention provide a method, system and computer program product for correct positioning of a plurality of edge guides of a media source assembly in an image forming device. The image forming device includes a media source assembly, a notification mechanism, and a display system. The media source assembly includes an input media tray, a plurality of edge guides, and a plurality of sensors. A user loads documents or a stack of print media relative to a first edge guide in the input media tray. A first edge guide sensor may sense the proximity of the documents or the print media with the first edge guide, and may provide feedback relating to the placement of the documents relative to the first edge guide. When the first edge guide sensor senses that the documents or the print media are placed proximate to the first edge guide, the notification mechanism may generate a confirmatory notification for the user accordingly. Once the documents are adjusted against the first edge guide, the user may adjust a second edge guide. A second edge guide sensor may sense the proximity of the documents or the print media with the second edge guide, and may provide feedback relating to the placement of the documents relative to the second edge guide. When the second edge guide sensor senses that the documents or the print media are placed proximate to the second edge guide, the notification mechanism may generate another confirmatory notification for the user. The notifications may then be communicated to the user by the image forming device. In an embodiment of the invention, the notifications may be represented in the form of at least one of a text, a graphical representation, and a video. In another embodiment of the invention, the notifications may be generated in the form of audio instructions from one or more speakers that may be embedded in the image forming device. In yet another embodiment of the invention, the notifications may be represented in the form of light signals from one or more Light Emitting Diodes (LEDs).

In accordance with an embodiment of the present invention, the image forming device may motivate an automatic adjustment of the plurality of edge guides by using one or more motors. Once the documents or the print media have been loaded in the input media tray, the motor may automatically start the adjustment of at least one of the first edge guide and the second edge guide. The first edge guide sensor and the second edge guide sensor may sense the proximity of the documents or the print media with the first edge guide and the second edge guide, and may then provide the confirmatory notification for the user as described above.

The method and system according to the embodiments of the present invention improve the positioning of a plurality of edge guides of a media source assembly by sensing the proximity of the documents or the print media with the plurality of edge guides. The method and system may also prompt a user through multiple video/audio instructions to adjust the edge guides. The automatic mode for adjusting the plurality of edge guides helps in minimizing the involvement of the user.

BRIEF DESCRIPTION OF THE DRAWINGS

The features mentioned above and others, and the advantages of this invention, and the manner of attaining them, will become more apparent and the invention will be better understood by reference to the following description of the embodiments of the invention, taken in conjunction with the accompanying drawings, wherein.

DETAILED DESCRIPTION OF DRAWINGS

Figure 1A:
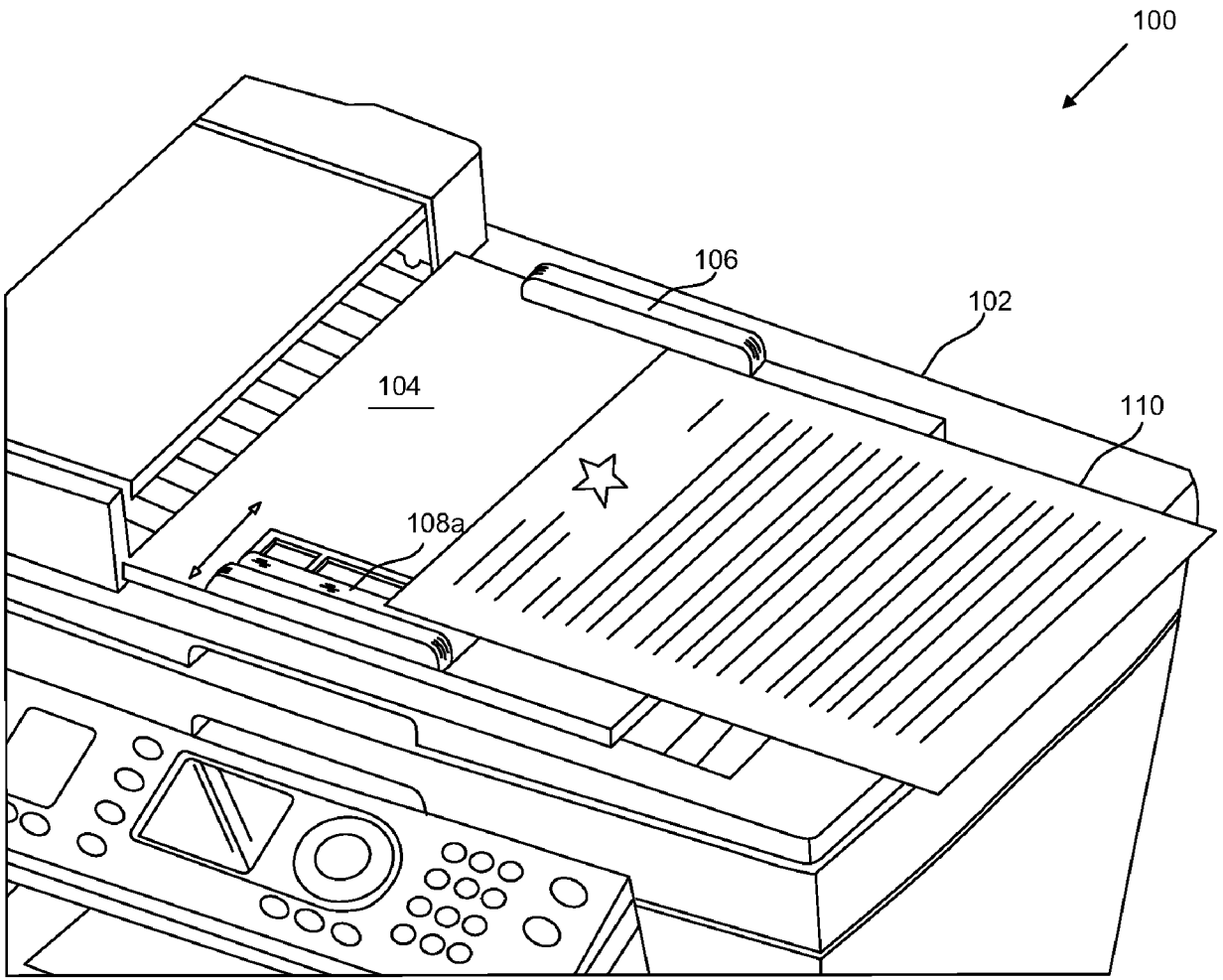
Fig. 1A PRIOR ART
FIGS. 1A and 1B are illustrations of a conventional image forming device as is known in the art.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that the embodiments of the invention include both hardware and electronic components or modules that, for purposes of discussion, may be illustrated and described as if the majority of the components were implemented solely in hardware. However, one of ordinary skill in the art, and based on a reading of this detailed description, will recognize that, in at least one embodiment, the electronic-based aspects of the invention may be implemented in software. As such, it should be noted that a plurality of hardware- and software-based devices, as well as a plurality of different structural components, may be utilized to implement the invention. Furthermore, as described in the subsequent paragraphs, the specific mechanical configurations illustrated in the drawings are intended to exemplify the embodiments of the invention and that other alternative mechanical configurations are possible.

The embodiments of the present invention provide a system, method and computer program product for positioning a plurality of edge guides of a media source assembly in an image forming device. The term "image" as used herein encompasses any printed or digital form of text, graphics, or a combination thereof. The term, "image forming device" as used herein encompasses devices such as color and black-and-white copiers, color and black-and-white printers, color and black-and-white scanners, fax machines, and so-called "all-in-one devices" that incorporate multiple functions such as scanning, copying, and printing capabilities in one device. Such image forming devices may utilize ink jet, dot matrix, dye sublimation, laser, and any other suitable print formats.

Figure 1B:
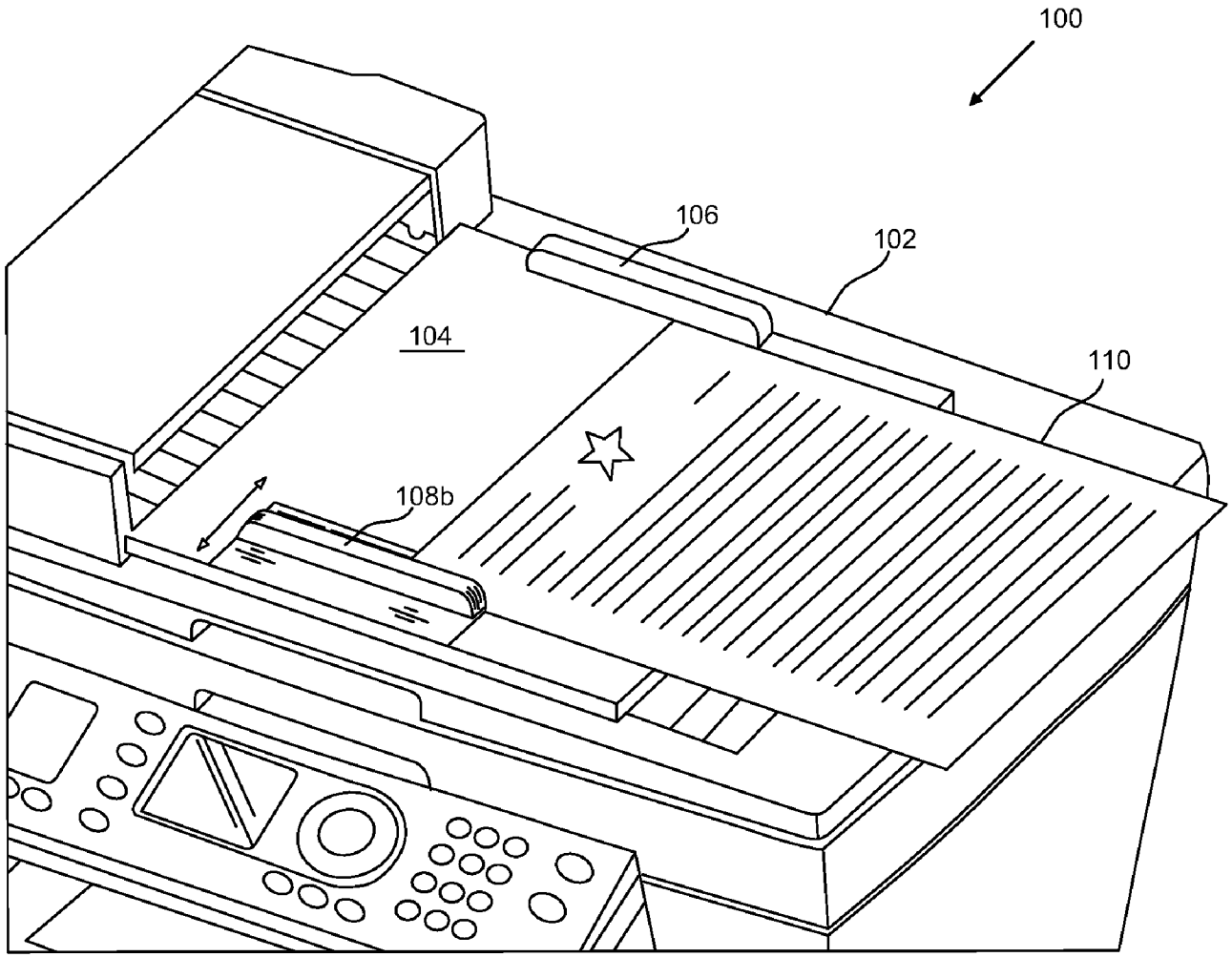
Fig. 1B PRIOR ART

FIGS. 1A and 1B are illustrations of a conventional image forming device 100 as is known in the art. Conventional image forming device 100 includes a media source assembly 102. Media source assembly 102 includes an input media tray 104, a first edge guide 106, and a second edge guide 108. Input media tray 104 is operatively coupled to first edge guide 106 and second edge guide 108, and is designed to receive a stack of sheets of print media, hereinafter referred to as a document 110. As depicted in FIGS. 1A and 1B, first edge guide 106 may be fixed, and second edge guide 108 may be adjustable.

A user may load document 110 for image formation with respect to first edge guide 106 in input media tray 104. Examples of document 110 may include, but are not limited to, plain sheets of paper, cardstocks, transparencies, labels, envelopes, sheets of paper containing text and/or graphics, and the like. Initially, second edge guide 108*a* may be placed away from document 110, as illustrated in FIG. 1A, and later, as illustrated in FIG. 1B, the user may adjust second edge guide 108*b* to place second edge guide 108*b* proximate to document 110. Subsequently, conventional image forming device 100 may process document 110.

However, conventional image forming device 100 may not provide notifications to the user for confirming the adjustment of document 110 relative to first edge guide 106 and second edge guide 108. Further, it is difficult to engage the user in adjusting second edge guide 108. Furthermore, if document 110 is not properly adjusted by the user, it may get skewed, and thus, cause jams in conventional image forming device 100.

Figure 2:
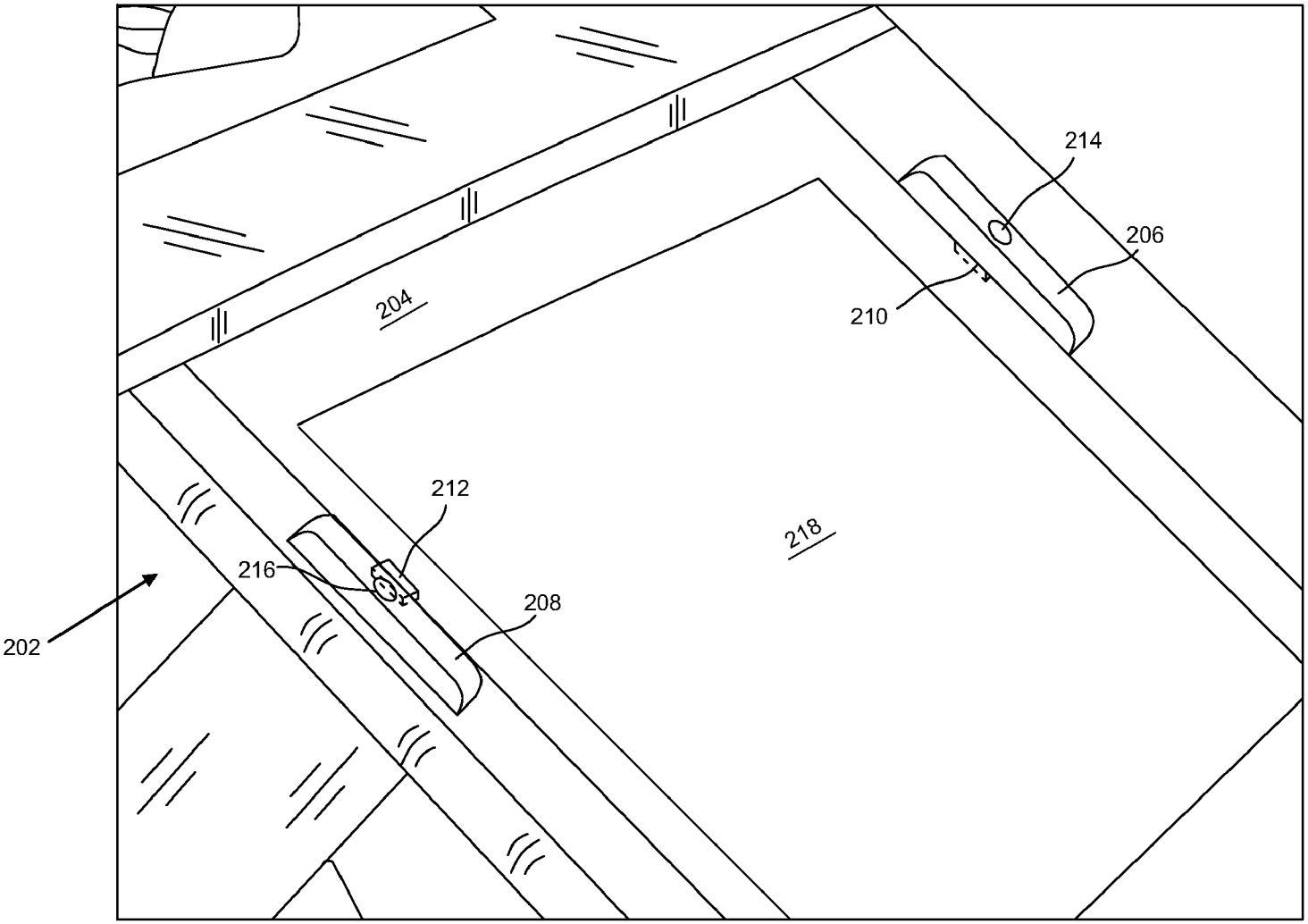
FIG. 2 is an illustration of a media source assembly of an image forming device, in accordance with an exemplary embodiment of the invention.

FIG. 2 is an illustration of a media source assembly 202 of an image forming device, in accordance with an exemplary embodiment of the invention. Media source assembly 202 includes an input media tray 204, a plurality of edge guides such as a first edge guide 206 and a second edge guide 208, a plurality of sensors such as a first edge guide sensor 210 and a second edge guide sensor 212, and a plurality of indicators such as a first indicator 214 and a second indicator 216.

Media source assembly 202 receives a plurality of documents, such as document 218*a*, 218*b*, 218*c*, and so forth, hereinafter referred to as document 218, in input media tray 204. In an embodiment of the invention, document 218 may be print media used for printing an electronic document which may be stored in the image forming device. In another embodiment of the invention, document 218 may be a document containing text, graphics, or a combination thereof. Input media tray 204 may be operatively coupled with first edge guide 206 and second edge guide 208, which are designed for adjusting document 218 in input media tray 204. First edge guide 206 includes first edge guide sensor 210 and first indicator 214, which are operatively coupled with each other. First edge guide sensor 210 is configured to sense the proximity of document 218 with first edge guide 206, and accordingly it provides a notification through first indicator 214. Second edge guide 208 includes second edge guide sensor 212 and second indicator 216, which are operatively coupled with each other. Second edge guide sensor 212 is configured to sense the proximity of document 218 with second edge guide 208, and accordingly it provides another notification through to second indicator 216.

A user may load document 218 relative to first edge guide 206 in input media tray 204 for image formation. In an embodiment of the present invention, the image forming device may guide the user to load document 218 in input media tray 204 by displaying at least one of a text message, a graphical representation, and a video representation on a display. Examples of the display may include, but are not limited to, a display panel on the image forming device, a host driver display, and an input media tray display. In another embodiment of the invention, the user may be guided through audio instructions from speakers that may be embedded in the image forming device. Further, first edge guide 206 may be fixed and second edge guide 208 may be adjustable, in accordance with an embodiment of the invention. First edge guide 206 includes a sensor, such as first edge guide sensor 210, which may sense the proximity of document 218 with first edge guide 206. In an embodiment of the invention, first edge guide sensor 210 may be a reflective optical sensor, which may be positioned under input media tray 204 and close to first edge guide 206. First edge guide sensor 210 may sense the proximity of document 218 with respect to first edge guide 206, and accordingly it may provide a notification through first indicator 214 representing the placement of document 218 relative to first edge guide 206. When first edge guide sensor 210 senses that document 218 is placed proximate to first edge guide 206, it may provide a confirmatory notification to the user through first indicator 214 to confirm the placement of document 218 relative to first edge guide 206, in accordance with various embodiments of the invention.

Similarly, the user adjusts second edge guide 208. In an embodiment of the present invention, the image forming device may guide the user to adjust second edge guide 208 relative to document 218 by displaying text, a graphical representation, or a video representation on the display. In another embodiment of the invention, the user may be guided through audio instructions from the speakers that may be embedded in the image forming device. Second edge guide 208 includes a sensor, such as second edge guide sensor 212, which senses the proximity of document 218 with second edge guide 208. In an embodiment of the invention, second edge guide sensor 212 may be a strain gauge sensor, which may protrude from a slot on second edge guide 208. When document 218 is placed away from second edge guide 208, second edge guide sensor 212 remains in its initial position and may provide a predefined value of resistance or voltage to second indicator 216. However, when document 218 is placed proximate to second edge guide 208, document 218 may exert a pressure on second edge guide sensor 212. Due to the pressure, second edge guide sensor 212 moves inside the slot and its predefined value of the resistance or voltage is changed. As a result, second edge guide sensor 212 may provide another confirmatory notification to the user through second indicator 216 to confirm the adjustment of second edge guide 208 relative to document 218, in accordance with various embodiments of the invention.

In accordance with various embodiments of the invention, first indicator 214 and second indicator 216 may represent the notification provided by first edge guide sensor 210 and second edge guide sensor 212 using various techniques. In an embodiment of the invention, first indicator 214 and second indicator 216 may be a Light Emitting Diode (LED), which may remain in an off state when document 218 is placed away from the corresponding edge guide such as first edge guide 206 and second edge guide 208. Similarly, the LED may turn to an on state when document 218 is placed proximate to the corresponding edge guide. In another embodiment of the invention, first indicator 214 and second indicator 216 may be an LED, which may notify the proximity of document 218 with the corresponding edge guide to the user through different colors. For example, when document 218 is placed away from the edge guide, the corresponding indicator such as first indicator 214 and second indicator 216 may turn red. Similarly, when document 218 is placed proximate to the edge guide, the corresponding indicator may turn green. In yet another embodiment of the invention, first edge guide sensor 210 and second edge guide sensor 212 may initiate notifications including text messages to represent the proximity of document 218 with the corresponding edge guide. In an embodiment of the invention, the notifications may be displayed on the display system. For example, the notifications may include text messages for the user to change the placement of document 218 until it is placed in a proper position. Once document 218 is placed in the proper position, a message may be provided to the user to confirm that document 218 is placed correctly. In another embodiment of the invention, audible notifications may be provided to the user through the speakers that may be embedded in the image forming device. For example, the speakers may provide instructions to guide the user to place document 218 proximate to first edge guide 206 and second edge guide 208. In various embodiments of the invention, any combination of the above may be used.

In an exemplary embodiment of the invention, media source assembly 202 may be a rack and a pinion adjustable assembly with adjustable first edge guide 206 and second edge guide 208 relative to input media tray 204. The user may load document 218 at the center of input media tray 204. In an embodiment of the invention, input media tray 204 may include a document-present sensor (not shown) which may provide feedback relating to the loading of document 218 in input media tray 204. As document 218 is loaded, a leading edge of document 218 may trigger the document-present sensor. Once the document-present sensor is triggered, the image forming device may direct the user through the display to adjust first edge guide 206 and second edge guide 208 towards document 218. First edge guide sensor 210 and second edge guide sensor 212 may sense the proximity of document 218 with the corresponding first edge guide 206 and second edge guide 208. When either of the plurality of edge guide sensors, i.e., at least one of first edge guide sensor 210 and second edge guide sensor 212, senses that document 218 is placed proximate to the corresponding edge guide, the corresponding sensor may provide the confirmatory notification to the user through the corresponding indicator such as first indicator 214 or second indicator 216, in accordance with various embodiments of the invention described above. Subsequently, the image forming device may continue to direct the user to adjust the other edge guide until both the indicators, such as first indicator 214 and second indicator 216, confirm the adjustment of the edge guides relative to document 218. Once both the indicators confirm the adjustment, the image forming device gives an indication to the user that it is ready for the next operation.

In another exemplary embodiment of the invention, first edge guide 206 and second edge guide 208 may be automatically adjustable by using one or more motors (not shown) in the image forming device. The user may load document 218 in input media tray 204. As document 218 is loaded, it triggers the document-present sensor. Once the document-present sensor is triggered, the image forming device may start the motor to move first edge guide 206 and second edge guide 208 towards document 218. First edge guide sensor 210 and second edge guide sensor 212 may sense the proximity of document 218 with the corresponding first edge guide 206 and second edge guide 208. When either of the plurality of edge guide sensors, i.e., at least one of first edge guide sensor 210 and second edge guide sensor 212, senses that document 218 is placed proximate to the corresponding edge guide, the corresponding sensor may provide a confirmatory notification to the user through the corresponding indicator such as first indicator 214 or second indicator 216, in accordance with various embodiments of the invention described above. Thereafter, the edge guide that has been sensed to be proximate to document 218 may remain in its position and the image forming device may again start the motor to adjust the other edge guide. Once both the indicators confirm the adjustment, the image forming device may stop the motor and give an indication to the user that it is ready for the next operation.

In various embodiments of the invention, input media tray 204 may be either internal or external with respect to the image forming device.

Figure 3A:
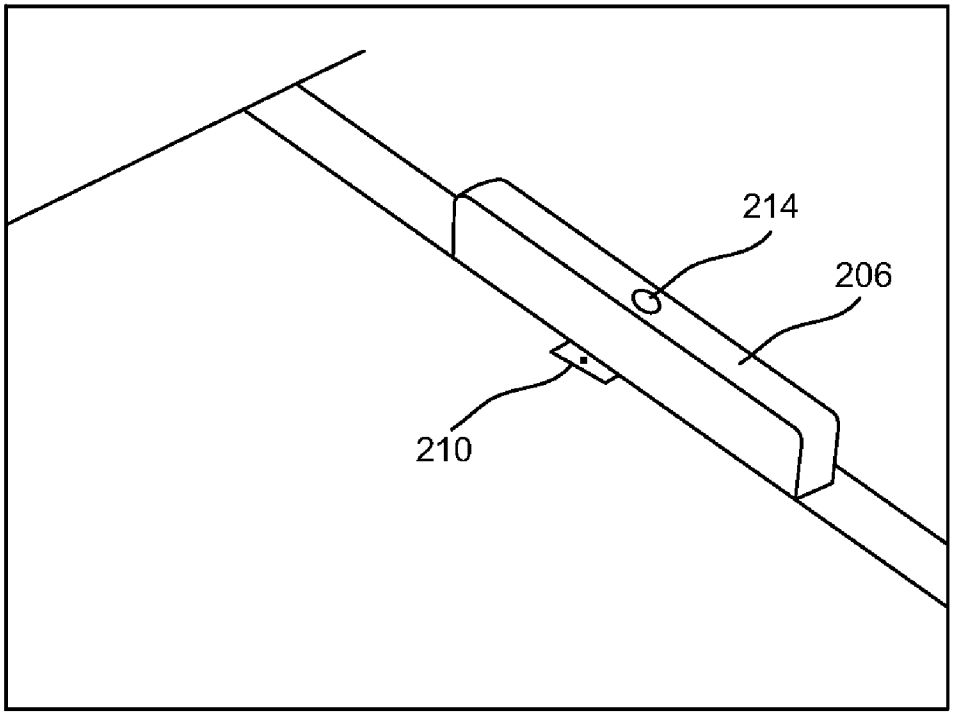
FIG. 3A is an isometric view of a first edge guide with a first edge guide sensor and a first indicator, in accordance with another exemplary embodiment of the invention.
Figure 3B:
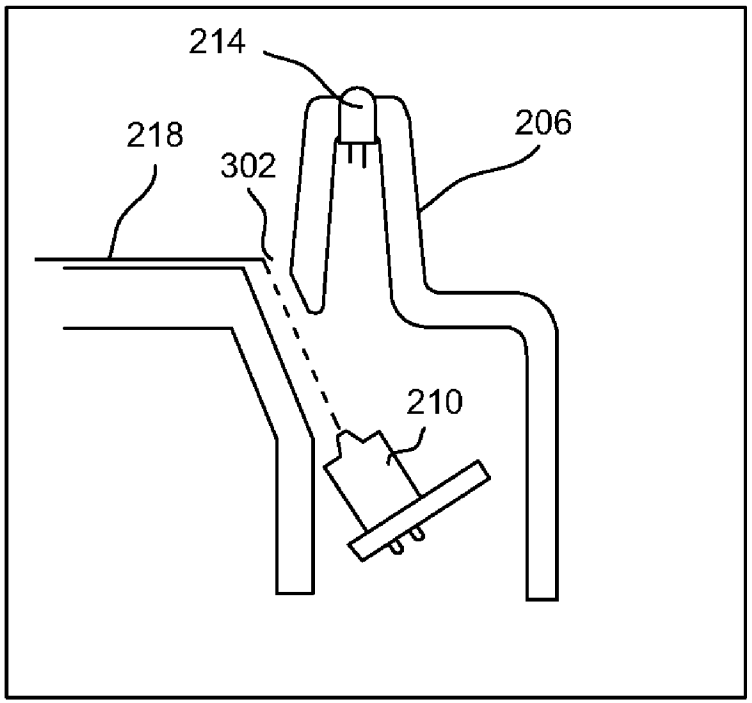
FIG. 3B is a cross-sectional front view of the first edge guide with the first edge guide sensor and the first indicator, in accordance with another exemplary embodiment of the invention.

FIG. 3A is an isometric view and FIG. 3B is a cross-sectional view of first edge guide 206 with first edge guide sensor 210 and first indicator 214, in accordance with an exemplary embodiment of the invention. FIGS. 3A and 3B include first edge guide 206, first edge guide sensor 210, first indicator 214, document 218, and a tray cover slot 302. First edge guide sensor 210 is connected to first indicator 214 by using a standard circuitry, which is well known in the art. Examples of first edge guide sensor 210 may include, but are not limited to, a reflective optical sensor, a mechanical arm with opto-interrupter, an over travel switch, and a strain gauge sensor. In an embodiment of the invention, as shown in FIG. 3B, first edge guide sensor 210 may be a reflective optical sensor, which is positioned under tray cover slot 302 of input media tray 204. Signal lines corresponding to first edge guide sensor 210 are communicatively connected with a digital Application-specific Integrated Circuit (ASIC) of the image forming device. The connection of the signal lines of first edge guide sensor 210 and the digital ASIC has been shown in detail in conjunction with FIG. 5.

In an embodiment of the invention, first edge guide sensor 210 may sense the proximity of document 218 with first edge guide 206 and provide a notification to the user through first indicator 214 of media source assembly 202. When first edge guide sensor 210 senses that document 218 is placed proximate to first edge guide 206, it may send a confirmatory notification through first indicator 214, in accordance with various embodiments of the invention as explained in conjunction with FIG. 2. Subsequently, on the basis of the feedback received from the signal lines of first edge guide sensor 210, the image forming device performs the next operation.

Figure 4B:
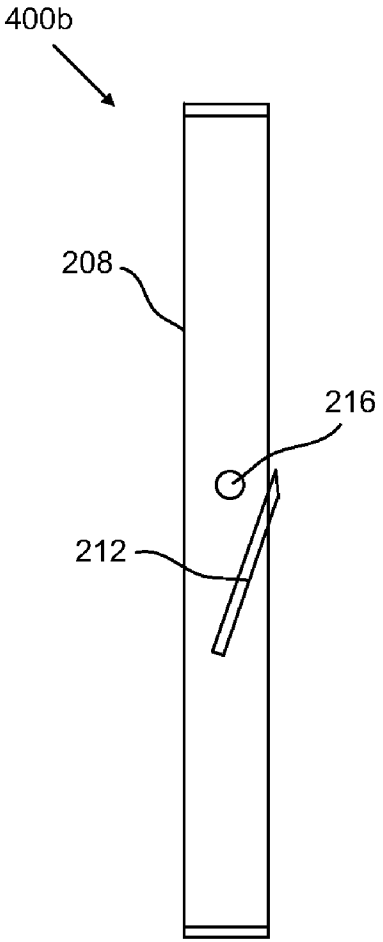
FIGS. 4B and 4D are top views of the second edge guide with the second edge guide sensor and the second indicator, in accordance with an exemplary embodiment of the invention.
Figure 4A:
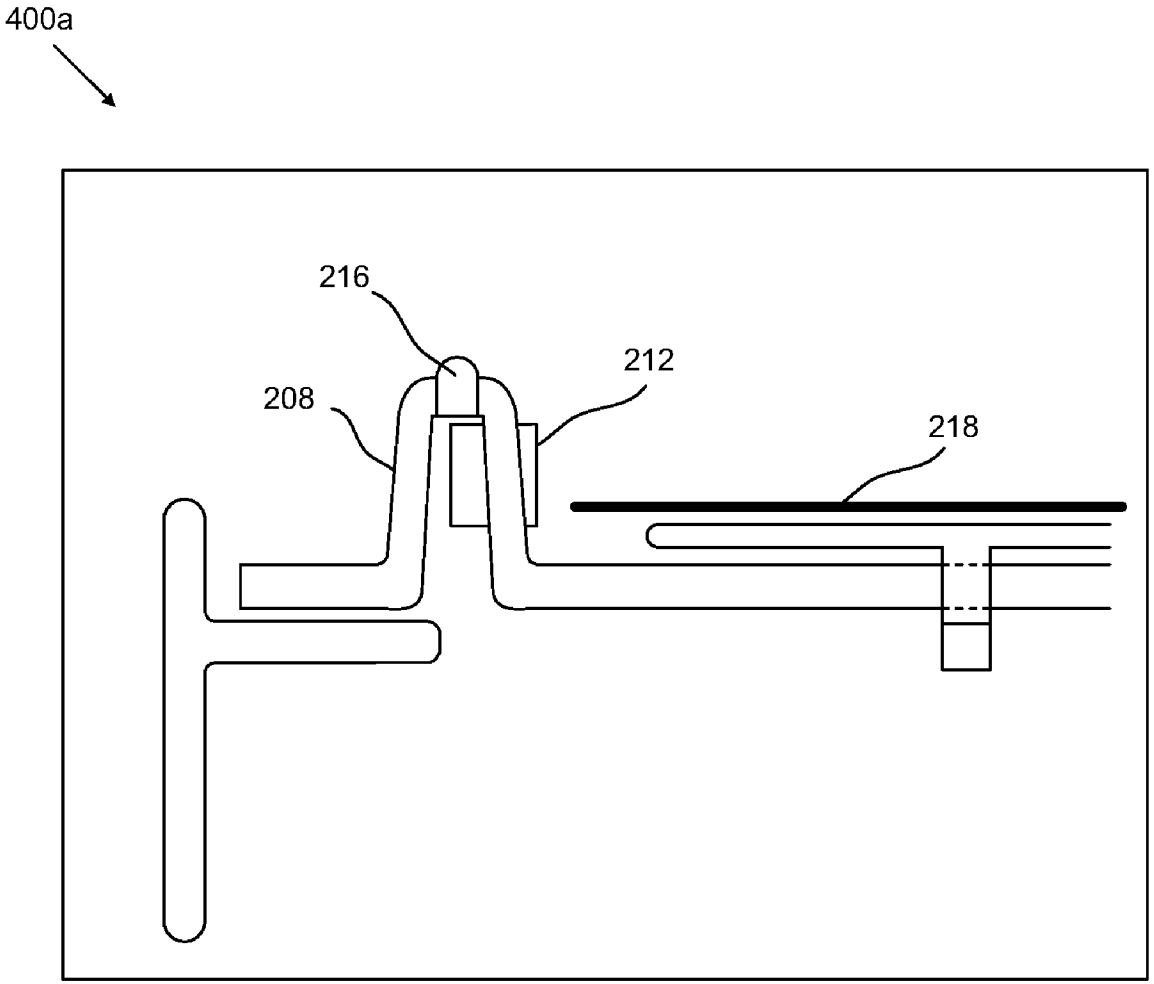
FIGS. 4A and 4C are side views of a second edge guide with a second edge guide sensor and a second indicator, in accordance with an exemplary embodiment of the invention.
Figure 4D:
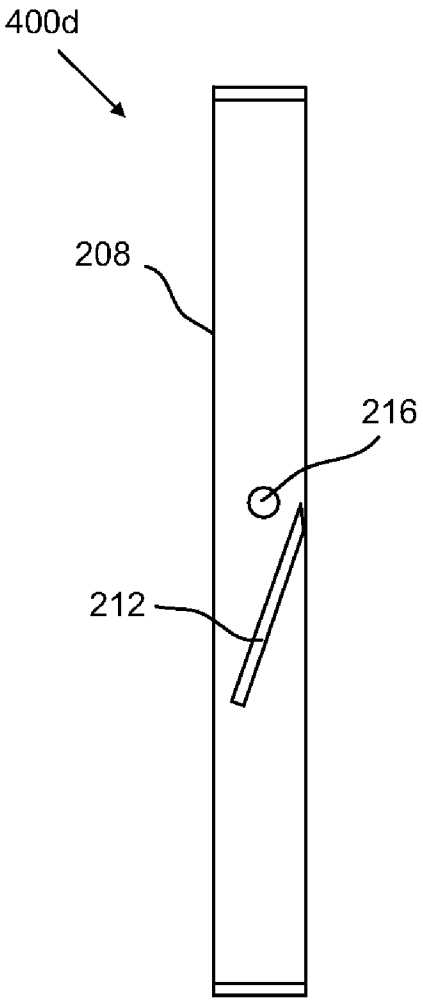
Figure 4C:
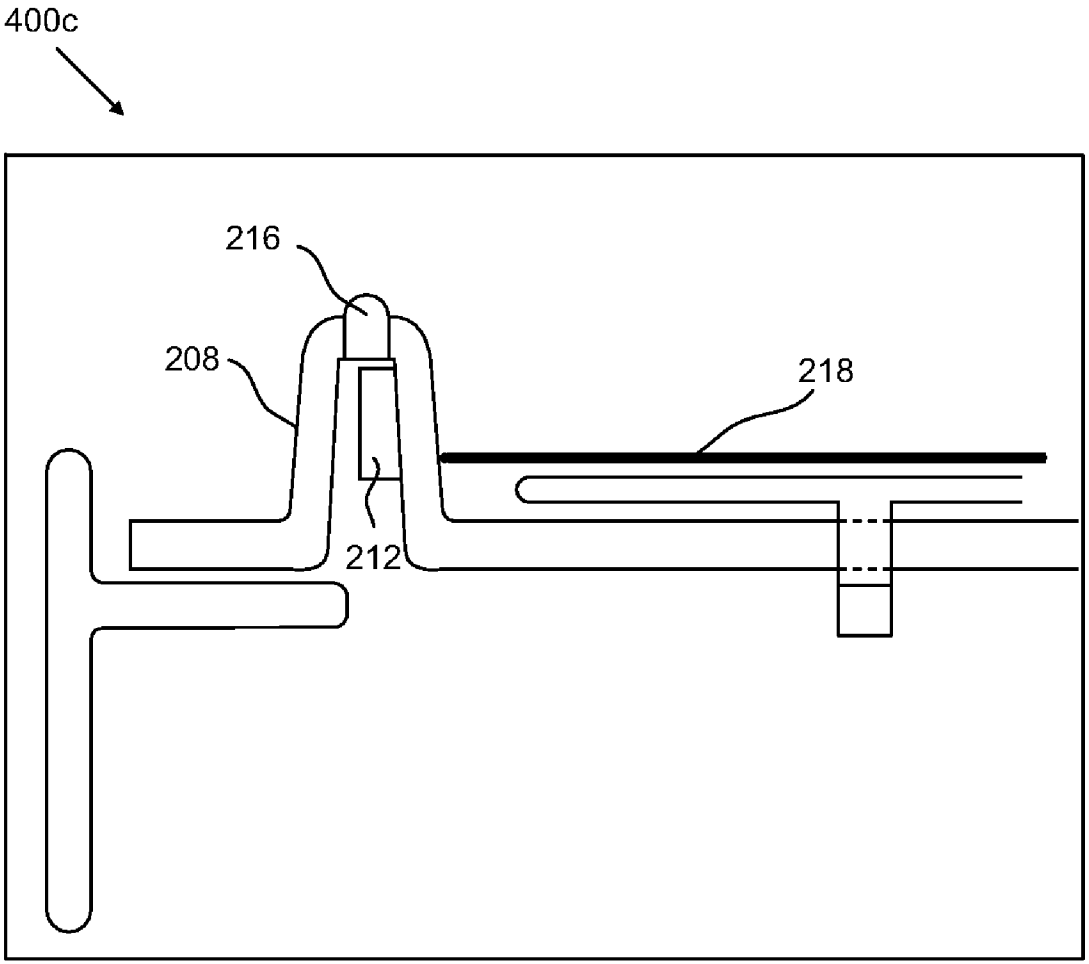

FIGS. 4A and 4C are side views 400*a* and 400*c*, and FIGS. 4B and 4D are top views 400*b* and 400*d* of second edge guide 208 with second edge guide sensor 212 and second indicator 216, in accordance with an exemplary embodiment of the invention. FIGS. 4A, 4B, 4C and 4D include second edge guide 208, second edge guide sensor 212, second indicator 216, and document 218. Second edge guide sensor 212 is connected to second edge guide 208 and second indicator 216 by using a standard circuitry, which is well known in the art. Examples of second edge guide sensor 212 may include, but are not limited to, a strain gauge sensor, a mechanical arm with opto-interrupter, an over travel switch, and a reflective optical sensor. In an embodiment of the invention, second edge guide sensor 212 may be a strain gauge sensor, which may protrude from a slot on second edge guide 208. Signal lines corresponding to second edge guide sensor 212 are communicatively connected with the ASIC of the image forming device.

As shown in side view 400*a* and top view 400*b*, when document 218 is placed away from second edge guide 208, second edge guide sensor 212 may remain in its initial position and provides a predefined value of resistance or voltage to second indicator 216. Accordingly, second edge guide sensor 212 may provide the notification through second indicator 216 representing that document 218 is placed away with respect to second edge guide 208. Further, as shown in side view 400*c* and top view 400*d*, when document 218 is placed proximate to second edge guide 208, document 218 may exert a pressure on second edge guide sensor 212. Due to the pressure, second edge guide sensor 212 may move inside the slot, and its predefined value of the resistance or voltage may change. As a result, second edge guide sensor 212 may provide the confirmatory notification to the user through second indicator 216 to confirm the adjustment of second edge guide 208 relative to document 218, in accordance with various embodiments of the invention as explained in conjunction with FIG. 2.

In an exemplary embodiment of the invention, as depicted in FIG. 2, first indicator 214 and second indicator 216 are LEDs that may get turned on or off, based on the proximity of document 218 with the corresponding edge guide. Additionally, in another embodiment, the LED may notify the proximity of document 218 with the corresponding edge guide to the user through different colors. In another embodiment of the invention, instead of using the LED, the image forming device may employ a display or a speaker, which may provide the notifications related to the proximity of document 218 with the corresponding edge guide through video/audio instructions.

Figure 5:
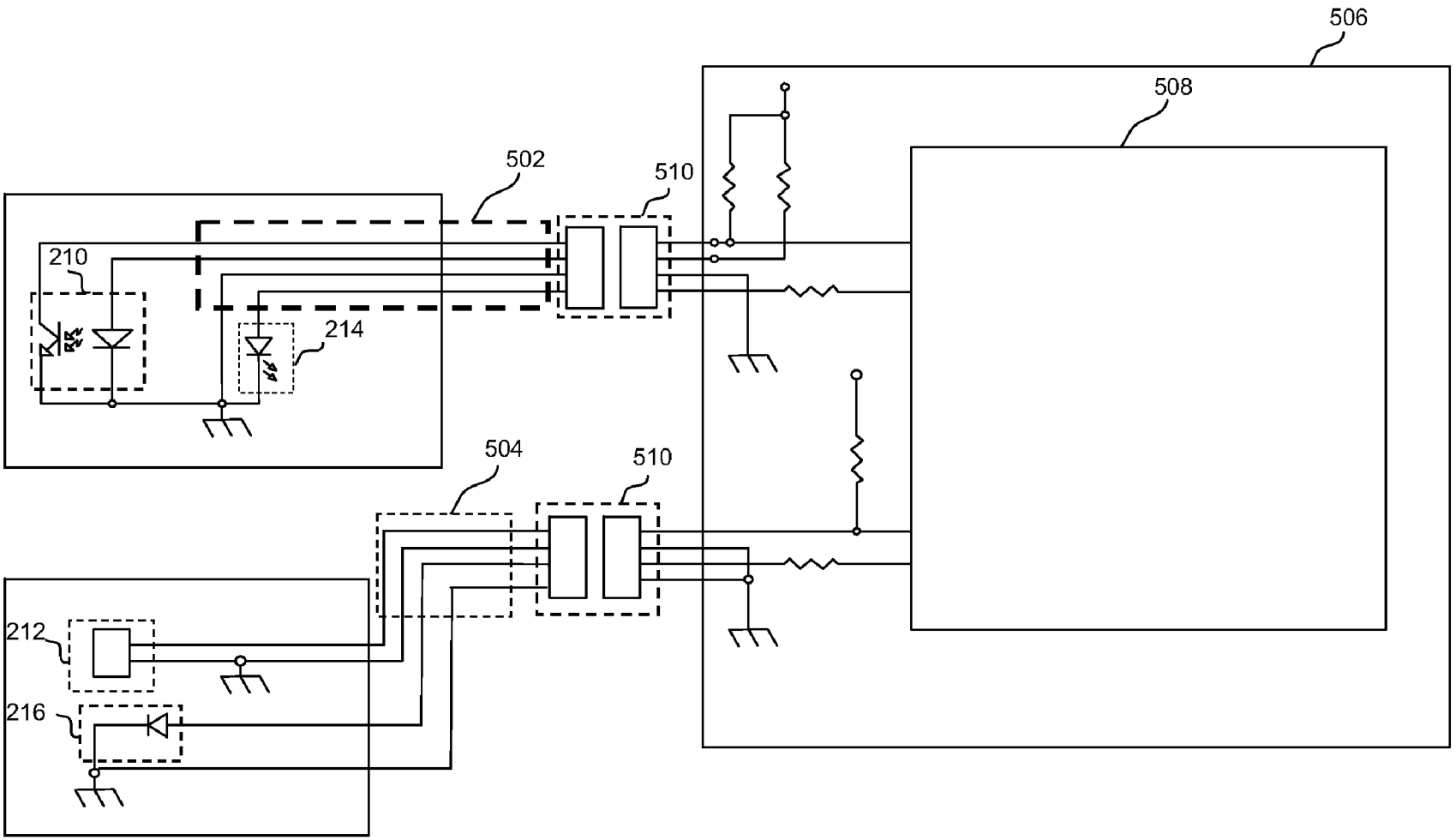
FIG. 5 is a block diagram illustrating an exemplary connection of signal lines of a first edge guide sensor and a second edge guide sensor to an exemplary digital Application-specific Integrated Circuit of an image forming device, in accordance with an embodiment of the invention.

FIG. 5 is a block diagram 500 illustrating an exemplary connection of signal lines of first edge guide sensor 210 and second edge guide sensor 212 with an exemplary digital Application-specific Integrated Circuit (ASIC) 508 of an image forming device, in accordance with an embodiment of the invention. Block diagram 500 includes first edge guide sensor 210, first indicator 214, a first set of signal lines 502, second edge guide sensor 212, second indicator 216, a second set of signal lines 504, a main board 506, a digital ASIC 508 and a four-pin contact arrangement 510. The exemplary connection of signal lines of first edge guide sensor 210 and second edge guide sensor 212 with digital ASIC 508 has been presented for purposes of illustration. It is not intended to be exhaustive or to limit the invention to the precise steps and/or forms disclosed, and obviously many modifications and variations are possible in light of the above teaching.

In an embodiment of the invention, when input media tray 204 is fixed, the wires corresponding to first set of signal lines 502 and second set of signal lines 504 are directly routed to main board 506. In another embodiment of the invention, if input media tray 204 is removable, first set of signal lines 502 and second set of signal lines 504 may be connected using four-pin contact arrangement 510 or similar removable connections that may be located at the ends of input media tray 204.

In an exemplary embodiment of the invention, media source assembly 202 may also allow the user to proceed with at least one of a scan, copy and fax operation before the completion of the adjustment of first edge guide 206 and second edge guide 208.

Figure 6:
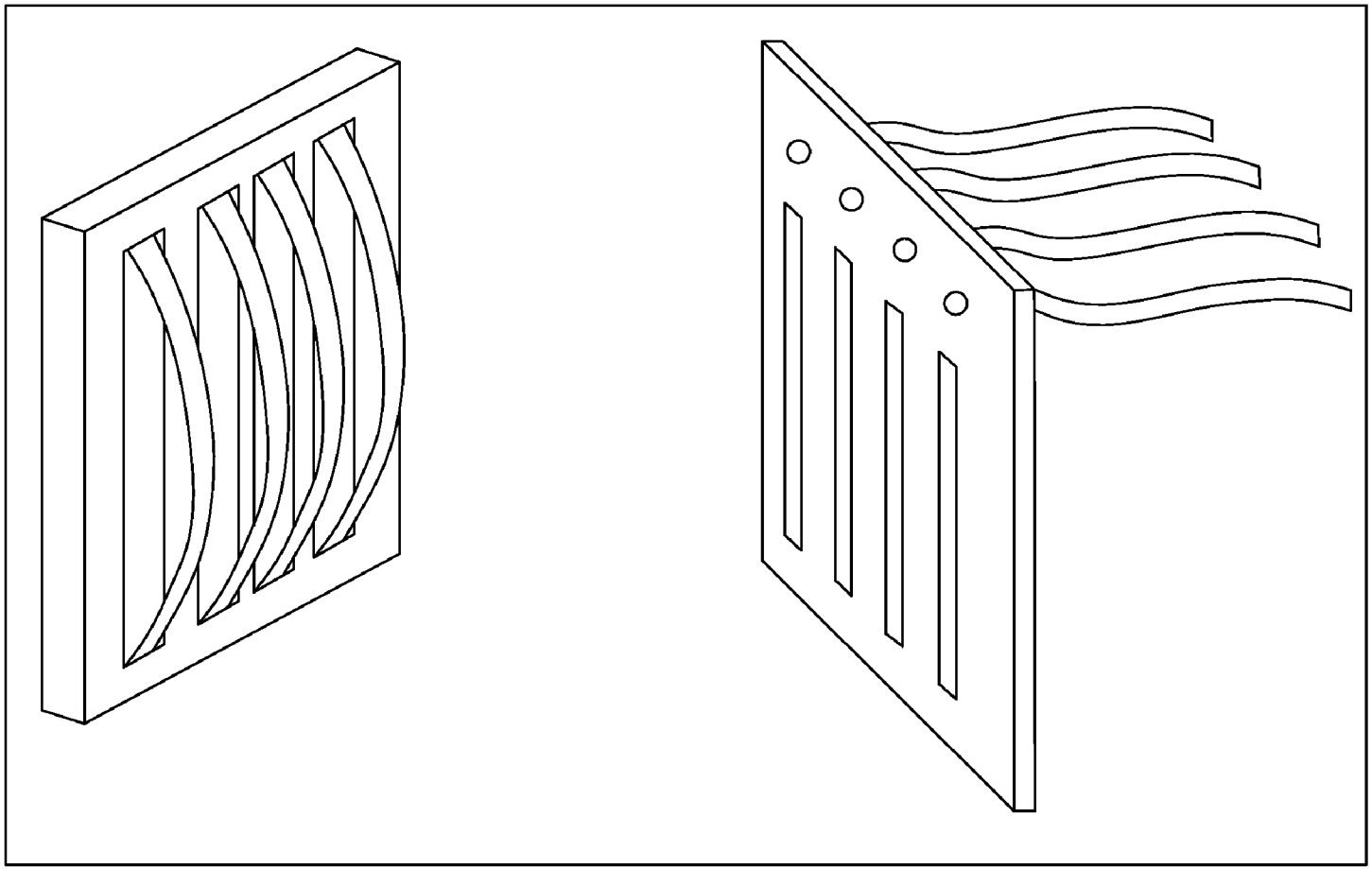
FIG. 6 is an isometric view of an exemplary four-pin contact arrangement on an image forming device, in accordance with an embodiment of the invention.

FIG. 6 is an isometric view of an exemplary four-pin contact arrangement 510 in an image forming device and media source assembly 202, in accordance with various embodiments of the invention. Four-pin contact arrangement 510 may be used to connect first set of signal lines 502 and second set of signal lines 504 to digital ASIC 508. The connections of first set of signal lines 502 and second set of signal lines 504 with digital ASIC 508 have been explained in detail in conjunction with FIG. 5. Four-pin contact arrangement 510 has been presented for purposes of illustration. It is not intended to be exhaustive or to limit the invention to the precise steps and/or forms/embodiments disclosed, and obviously many modifications and variations are possible in light of the above teaching.

The system and method described above improves the positioning of a plurality of edge guides of the media source assemblies by providing alternative ways or methods. The method and system may prompt a user through multiple video/audio instructions to adjust the edge guides. The prompting may include, for example, guiding the user to adjust the plurality of edge guides through alternative methods or ways, such as a text message, a graphical representation, a video and an audio instruction. Further, the method and system require minimal user intervention.

The method and system for positioning a plurality of edge guides of the media source assembly, as described above with respect to various embodiments of the present invention or any of its components, may be embodied in the form of a computer readable program code for a computer system. Typical examples of a computer system include a general-purpose computer, a programmed microprocessor, a microcontroller, a peripheral integrated circuit element, and other devices or arrangements of devices that are capable of implementing the functions and operations described above.

Such a computer system comprises a computer, an input device, and a display unit. The computer may include a microprocessor and memory, both volatile and non-volatile. The computer system may also include a storage device such as a disk drive (hard disk drive, optical disk drive or solid state drive). The storage device can also be other similar means for loading computer programs or other instructions into the computer system. The computer system may also include a communication unit for accessing other databases and the Internet through an I/O interface. The communication unit may allow the transmission as well as reception of data from other databases. The communication unit may include a modem, an Ethernet card, or any other device which enables the computer system to connect to databases and networks such as LAN, MAN, WAN, and the Internet. The computer system may facilitate inputs from a user through input device, accessible to the system through the I/O interface.

The computer system executes a set of instructions that are stored in one or more computer usable mediums, in order to process input data. The storage elements may also hold data or other information as desired. The storage element may be in the form of an information source or a physical memory element present in the processing machine.

The set of instructions may include various commands that instruct the computer system to perform the specific tasks and operations described above. The set of instructions may be in the form of a software program. Further, the software may be in the form of a collection of separate programs, a program module with a larger program or a portion of a program module. The software may also include modular programming in the form of object-oriented programming. The processing of input data by the processing machine may be in response to user commands, results of previous processing or a request made by another processing machine.

The foregoing description of several methods and embodiments of the invention have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A media source assembly in an image forming device comprising:

an input media tray to receive one or more documents;

a plurality of edge guides coupled to the input media tray, the plurality of edge guides comprising:

one or more first edge sensors for sensing proximity of the one or more documents to a corresponding first edge guide of the plurality of edge guides;

one or more second edge sensors for sensing proximity of the one or more documents to a corresponding second edge guide of the plurality of edge guides, wherein the one or more first edge sensors and the one or more second edge sensors provide one or more feedback signals; and an indicator coupled to at least one of the one or more first edge sensors and the one or more second edge sensors for indicating to a user a placement of the one or more documents in the input media tray.

2. The media source assembly of claim 1, wherein the indicator comprises one or more Light Emitting Diodes (LEDs) which receive the one or more feedback signals and visually indicates to the user the placement of the one or more documents relative to at least one of the first edge guide and the second edge guide.

3. The media source assembly of claim 2, wherein the one or more LEDs are located on the first edge guide and the second edge guide.

4. The media source assembly of claim 1, wherein the indicator comprises a display which receives the one or more feedback signals and visually presents to the user the placement of the one or more documents relative to at least one of the first edge guide and the second edge guide.

5. The media source assembly of claim 1, wherein the indicator comprises one or more audio speakers which receive the one or more feedback signals and audibly presents to the user the placement of the one or more documents relative to at least one of the first edge guide and the second edge guide.

6. The media source assembly of claim 1, wherein the one or more first edge sensors and the one or more second edge sensors are selected from at least one of a reflective opto sensor, a strain gauge sensor, an opto-interrupter and an over travel switch.

7. The media source assembly of claim 1, wherein at least one of the first edge guide and the second edge guide is fixed relative to the input media tray.

8. The media source assembly of claim 1, wherein the plurality of edge guides are adjustable relative to the input media tray.

9. An image forming device comprising:

an input media tray for receiving one or more documents;

a plurality of edge guides for guiding the one or more documents in the input media tray, the plurality of edge guides comprising:

one or more first edge sensors for sensing proximity of the one or more documents to a first edge guide of the plurality of edge guides;

one or more second edge sensors for sensing proximity of the one or more documents to a second edge guide of the plurality of edge guides; and a notification mechanism for generating at least one notification, the notification mechanism being coupled to the one or more first edge sensors and the one or more second edge sensors, wherein the at least one notification is generated based on one or more feedback signals received from at least one of the one or more first edge sensors and the one or more second edge sensors for indicating a placement of at least one of the plurality of edge guides relative to the one or more documents in the input media tray.

10. The image forming device of claim 9, wherein the at least one notification is represented in the form of at least one of a light signal, text, a graphic, a video and an audio indication.

11. The image forming device of claim 9 further comprising one or more motors for automatically moving at least one of the plurality of edge guides relative to the one or more documents.

12. The image forming device of claim 9, wherein the at least one of the plurality of edge guides is fixed relative to the input media tray.

13. The image forming device of claim 9, wherein the plurality of edge guides are adjustable relative to the input media tray.

* * * * *